US009283445B2

(12) United States Patent
Moore

(10) Patent No.: US 9,283,445 B2
(45) Date of Patent: Mar. 15, 2016

(54) ADJUSTMENT DEVICE

(75) Inventor: Simon Garry Moore, Hamilton (NZ)

(73) Assignee: PUKU LIMITED, Auckland (NZ)

( * ) Notice: Subject to any disclaimer, the term of this patent is extended or adjusted under 35 U.S.C. 154(b) by 0 days.

(21) Appl. No.: 13/991,075

(22) PCT Filed: Dec. 2, 2011

(86) PCT No.: PCT/NZ2011/000251

§ 371 (c)(1),
(2), (4) Date: May 23, 2014

(87) PCT Pub. No.: WO2012/074416

PCT Pub. Date: Jun. 7, 2012

(65) Prior Publication Data

US 2014/0295987 A1 Oct. 2, 2014

(30) Foreign Application Priority Data

Dec. 2, 2010 (NZ) ..... 589658

(51) Int. Cl.

| | |
|---|---|
| ***A63B 53/02*** | (2015.01) |
| ***A63B 59/00*** | (2015.01) |
| ***A63B 53/06*** | (2015.01) |
| *A63B 71/06* | (2006.01) |
| *A63B 53/04* | (2015.01) |

(52) U.S. Cl.

CPC ..... *A63B 53/02* (2013.01); *A63B 53/06* (2013.01); *A63B 59/0074* (2013.01); *A63B 53/0466* (2013.01); *A63B 2053/023* (2013.01); *A63B 2053/0433* (2013.01); *A63B 2053/0491* (2013.01); *A63B 2071/0694* (2013.01)

(58) Field of Classification Search

CPC ..... A63B 53/02; A63B 59/0074; A63B 2053/023; A63B 53/06; A63B 2071/0694; A63B 53/0466; A63B 2053/0433; A63B 2053/0491

See application file for complete search history.

(56) References Cited

U.S. PATENT DOCUMENTS

| | | | | |
|---|---|---|---|---|
| 3,433,510 | A | 3/1969 | Hulterstrum | |
| 3,841,769 | A | 10/1974 | Bowerman | |
| 4,220,214 | A | 9/1980 | Benoit | |
| 4,332,388 | A | 6/1982 | Crow | |
| 6,109,815 | A | 8/2000 | Merlo | |
| 6,217,249 | B1 | 4/2001 | Merlo | |
| 6,561,476 | B2 | 5/2003 | Carnevali | |
| 6,863,622 | B1 * | 3/2005 | Hsu | A63B 53/06 473/306 |
| 7,438,645 | B2 * | 10/2008 | Hsu | A63B 53/02 473/246 |
| 8,147,350 | B2 * | 4/2012 | Beach | A63B 53/02 473/307 |
| 8,235,834 | B2 * | 8/2012 | De La Cruz | A63B 53/02 473/244 |
| 8,622,847 | B2 * | 1/2014 | Beach | A63B 53/02 473/246 |
| 8,876,626 | B2 * | 11/2014 | Suwa | A63B 53/02 473/246 |
| 2005/0049073 | A1 | 3/2005 | Herber | |

(Continued)

FOREIGN PATENT DOCUMENTS

| | | |
|---|---|---|
| EP | 0285753 | 10/1988 |

*Primary Examiner* — Stephen Blau

(74) *Attorney, Agent, or Firm* — Fay Sharpe LLP

(57) ABSTRACT

An adjustable connector is provided including a first part and a second part, each part including a main body having a longitudinal axis. One part includes at least one first locator, and the other part includes at least two second locators. The connector is configured such that engagement of the first locator with different second locators results in different orientations of the longitudinal axes of the parts with respect to one another. Each part includes a frustum shaped surface, where the surfaces are configured to abut against each other in at least one orientation of the longitudinal axes.

18 Claims, 11 Drawing Sheets

(56) References Cited

U.S. PATENT DOCUMENTS

| | | | | |
|---|---|---|---|---|
| 2010/0120552 | A1 | 5/2010 | Sander et al. | |
| 2010/0144459 | A1 | 6/2010 | Sato et al. | |
| 2010/0197422 | A1 | 8/2010 | Thomas et al. | |
| 2010/0197423 | A1 | 8/2010 | Thomas et al. | |
| 2011/0111881 | A1* | 5/2011 | Sander | A63B 53/02 473/307 |
| 2011/0123265 | A1 | 5/2011 | Moore | |
| 2012/0034996 | A1* | 2/2012 | Murphy | A63B 53/02 473/307 |
| 2013/0116062 | A1* | 5/2013 | Zimmerman | A63B 53/02 473/307 |
| 2013/0288816 | A1* | 10/2013 | Nakamura | A63B 53/02 473/309 |
| 2013/0296069 | A1* | 11/2013 | Beach | A63B 53/02 473/307 |
| 2014/0080617 | A1* | 3/2014 | Llewellyn | A63B 53/0466 473/246 |

* cited by examiner

ADJUSTMENT DEVICE

STATEMENT OF CORRESPONDING APPLICATIONS

This application is based on the New Zealand Provisional Patent Application Number 589658 filed 2 Dec. 2010, and the New Zealand Complete after Provisional Patent Application Number 589658 filed 31 Oct. 2011, the entire contents of which are incorporated herein by reference.

TECHNICAL FIELD

The present invention relates to an adjustable connector. In particular, the present invention relates to an adjustable connector for connecting and orienting at least two bodies with respect to one another.

BACKGROUND ART

The relative orientation of two or more connected objects often can be a critical aspect of the way the objects perform their function. This may be illustrated simply with reference to a golf club, although those skilled in the art will recognise numerous other products and situations where similar issues arise and reference throughout this specification to golf clubs only should not be considered limiting.

A golf club has a shaft connected to a club head through a hosel in the club head.

There are three primary axes in relation to a golf club head to be considered:

1. X axis: ball to target line, at the centre of the ball level, passing through the centre of a ball (if present);
2. Y axis: ball to golfer line, at the centre of the ball level, parallel to the ground and substantially 90 degrees to X axis
3. Z axis: ball to sky line, perpendicular to the ground plane, and the X and Y axes.

There is a point in the club head, at the centre of the ball level, where all three axes intersect.

The relative orientation of the club head with respect to the shaft is a critical element in the performance of the club. Three aspects are particularly important when the golfer is in the address position with the club resting on the ground:

1. The loft angle, which relates to the angle or slope of the club head face with respect to the Z axis. For a driver golf club the loft angle of the face is generally 7° to 15°;
2. The lie angle, which relates to the angle of the axis of the golf shaft with respect to the Y axis. For a driver golf club the lie angle of the face is generally 58°;
3. The face angle which relates to whether the clubface is looking down the fairway. A face angle is open if the face is turned away (about the vertical Z axis) from the target to the right hand side of the fairway for a right hand golfer, and neutral if pointing at the target, and closed if the face is turned away from the target to the left hand side of the fairway for a right hand golfer. The face angle for a driver golf club is generally neutral but can be up to 2° open or closed by design.

Golf clubs for different shots generally will have different loft lie and face angles. However, even for similar clubs from different manufacturers (e.g., 8 irons) there is generally a range of these angles to suit different golfers.

One consequence of this is the necessity for suppliers of golf clubs to maintain an inventory of clubs that cover the wide variation of lie and loft for each club. If a reliable and accurate method was available for varying the lie and loft of a club then it would be possible for a supplier to stock a smaller range of clubs which could be individually adjusted to the desired settings, thus saving costs to the supplier.

Another issue that could be addressed is the variation that can occur during manufacture of a golf club. It could be that a club may have a lie angle and/or loft that is different than that designated for the club as a consequence of manufacturing variation. It would be useful to have a method of correcting for this which could benefit the golfer by providing an accurately formed club, and the manufacturer/supplier in reduction of discarded clubs due to manufacturing error.

Further, some clubs are better configured by only changing two or even just one parameter, for example:

1. Drivers: Change loft and face angles only;
2. Fairway woods and hybrids: Change loft and lie angles only;
3. Irons and wedges: Change loft and lie angles only;
4. Putters: Change loft and lie angles only.

It may be seen that it would be useful to provide independent adjustment of the three parameters.

Previously known technology utilised sleeves having an angled internal bore, where rotation of the sleeve resulted in an adjustment of the angle of a shaft connected to the sleeve relative to the club head in which the sleeve was inserted. Other devices introduce a secondary angled bore to provide a wider range of settings.

While an advancement over previous methods of permanently deforming the connection between shaft and head, such techniques have several disadvantages.

For example, there is a significant amount of noise in that there are a number of unwanted, and/or compromised settings, which are not particularly useful or accurate. Preferably, this "setting noise" should be minimised or eliminated.

Further, the inclined bore technology either provides a limited range of adjustment, or is more complicated to use and expensive to manufacture.

It is an object of the present invention to address the foregoing problems or at least to provide the public with a useful choice.

Adjustment of a golf club has been discussed here as an example of a common situation where adjustment of the relative orientation of two objects, in this case a shaft and a club head of a golf club. However the general situation is very common, especially where the orientation of an object with respect to a shaft is involved.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

SUMMARY

According to one aspect of the present invention there is provided an adjustable connector including:

a first part and a second part, each including a main body having a longitudinal axis, wherein one part includes at least one first locator, and the other part includes at least two second locators, the connector configured such that engagement of the first locator with different second locators results in different orientations of the main body longitudinal axes with respect to one another, the connector characterised in that each part includes a frustum shaped surface configured to abut against each other in at least one orientation of the longitudinal axes.

Reference to a frustum in the context of the present invention should be understood to mean a portion of a three dimensional shape between two dissecting planes, wherein the area of the shape at one dissecting plane is greater than the area at the other dissecting plane.

In a preferred embodiment the frustum is a spherical frustum, although it should be appreciated that this is not intended to be limiting. For example, it is envisaged that a frustoconical shape may be used.

According to another aspect of the present invention there is provided an adjustable connector including:

a first part and a second part, each including a main body having a longitudinal axis, wherein one part includes at least one first locator, and the other part includes at least two second locators, the connector configured such that engagement of the first locator with different second locators results in different orientations of the main body longitudinal axes with respect to one another, the connector characterised in that each part includes a truncated spherical surface having a sagittal depth of less than half the radius of curvature of the truncated sphere, the surfaces configured to abut against each other in at least one orientation of the longitudinal axes.

Reference to sagittal depth should be understood to mean the depth of an arc. Sagittal depth may be determined using the equation:

$$s=r-\sqrt{(r^2-y^2)};$$

where s is sagittal depth, r is the radius of curvature, and y is one half of the diameter at the edge of the surface.

According to another aspect of the present invention there is provided a method of adjusting an adjustable connector substantially as described above, including the steps of:

abutting the surfaces to one another such that the at least one first locator engages one of the second locators; and moving the first part relative to the second part such that the first locator disengages with the second locator and engages with another second locator.

In a preferred embodiment the surfaces are configured to be complementary when abutted to one another in at least one orientation of the longitudinal axes.

Reference to an adjustable connector throughout this specification should be understood to refer to a device which in use is connected to, or forms part of, two or more objects—the device being configured such that adjustment of the adjustable connector alters the relative orientation of the objects.

Reference to first and second locators should be understood to mean any two features configured to interact in order to define a particular orientation of one part to the other. While it is envisaged that this may take the form of a male/female pair, it should be appreciated that this is not intended to be limiting.

Preferably one of the first or second locators is a protrusion, and the other a recess configured to receive the protrusion.

For example, it is envisaged that the first part includes a hemispherical protrusion, and the second part includes at least two hemispherical or circular recesses—each configured to receive the hemispherical protrusion.

One skilled in the art should appreciate that this is not intended to be limiting, and that the protrusion and recess may be any number of shapes and orientations.

For example, in a preferred embodiment the locators include at least one straight edge. In particular, it is envisaged that the locators may be substantially trapezoidal. It is envisaged that this may assist in resisting lifting of the locators relative to each other under load—particularly rotation of the parts relative to each other.

By defining the orientation of the parts, each position of the second locators on the second part may be considered a setting, where engaging the first locator or locators with a particular second locator or locators results in a particular orientation, and in particular inclination, of the longitudinal axes of the parts.

This orientation or inclination may be referred to herein as a resultant axis—the resting axis of a first part after relative repositioning of this first part relative to at least a second part. In general the first part has an initial axis, and then adjustment leads to a resultant axis which may be, but is generally not, collinear to the initial axis.

In a preferred embodiment the second locators are located at different distances on the second part relative to the longitudinal axis of the part.

In a preferred embodiment the radius of curvature of the frustum or truncated sphere surfaces are equal to or greater than 8 millimeters.

More preferably the radius of curvature of the surfaces are in the range of 15 to 25 millimeters, in particular 20 millimeters.

It is envisaged that optimising the radius of curvature of these surfaces may enable a number of advantageous arrangements.

In particular, this may increase the distance between second locators in order to provide the same change in angle between the axes of the parts. In doing so, the ease of use may be improved by providing a greater differentiation between settings.

It is envisaged that there will be a limited number of orientations of the axes which are actually relevant to the user. In the context of a golfing application in particular, the difference between these orientations may be subtle. The present invention allows the parts to be rotated relative to each other prior to applying the desired inclination. This enables the locators to be spread out across the surface of the part. Without this, the locators would either need to be smaller than desired for providing a strong connection, or could overlap—reducing the surface area of each locator and thus effectiveness of the connection, and making adjustment difficult.

This increased or maximised separation may also enable larger locator details to be used. In doing so, ease of engaging the locators may be improved, or a greater connection between locators created. Alternatively, or additionally, the increased separation may allow more second locators (and thus a greater number of settings) to be positioned on the surface.

Further, it is envisaged that such a curvature may provide an increased area of surface contact between the surfaces. As a result, if the parts are clamped or fastened together, the resulting load may be better distributed onto the parts.

It is also envisaged that such maximised surface area may also increase friction between the parts. This is important in resisting rotation of the parts once in a desired position, particularly in applications with sudden application of force, such as the striking of a golf ball with a club.

The inventor has also identified that a shallower curvature, or greater radius of curvature, may also provide easier disengagement of the parts by minimising or eliminating a taper lock effect under load, which would otherwise bind the parts together making adjustment difficult.

By providing a sagittal depth of less than half the radius of curvature, and/or a surface in the form of a frustum, the surfaces of the present invention may retain the advantageous features discussed above, while minimising the physical dimensions of the parts.

For example, golf club hosels are typically no more than 16 mm in diameter. A steeper interface for use in a golf club assembly, for example in a ball and socket scenario, would need to be within the confines of that 16 mm to disguise the ball visually. In order to fit, the ball radius would need to be no more than 8 mm. Such a small bearing surface may have issues addressing the factors outlined above.

In a preferred embodiment the locators are position on the frustum or truncated sphere surfaces.

The following describes a number of possible second locator patterns for two examples wherein the locators are positioned on the surfaces, each with four second locators defining the resultant axes. Rotation is given about the longitudinal axis of the part.

Example 1

| Locator | Rotation (degrees) | Distance from axis (mm) |
|---|---|---|
| 1 | 0 | 4.8 |
| 2 | 91 | 5.1 |
| 3 | 180 | 5 |
| 4 | 265 | 5.3 |

Example 2

| Locator | Rotation (degrees) | Distance from axis (mm) |
|---|---|---|
| 1 | 0 | 9.5 |
| 2 | 35 | 6.1 |
| 3 | 233 | 15 |
| 4 | 293 | 2.6 |

It should be appreciated that any number of combinations may be used, depending on the desired result axes to be provided.

The present invention enables the locators to be positioned at the specific positions required to provide useful orientations, without additional unwanted settings complicating adjustment.

It is envisaged that one of the surfaces may be generally convex, and the other surface is generally concave.

It is envisaged that the convex surface may be provided at least partially by an object to which the part having the convex surface is connected to or integrated into. For example, the surface of a golf club head around the entrance to the hosel is typically domed. This domed area may provide the convex surface of the present invention, where one of the parts is inserted within the hosel.

It should be appreciated that reference to the surfaces being convex and concave respectively is not intended to be limiting. For example, it is envisaged that the surfaces may be conical, or sloping towards the longitudinal axes of the respective parts. In these embodiments is envisaged that the discussion above with regard to maximising the radius of the curved surfaces will apply—but with reference to minimising the incline or decline of the respective bearing surfaces as opposed to maximising the radius of curvature.

Further, the preferred radii of curvature of such surfaces are envisaged in the context of golf clubs and typical structure of same. It should be appreciated that the present invention may be applied in other situations in which the scale will vary from that discussed here, and that determination of an optimal radius for such curved bearing surfaces will depend on the application.

In a preferred embodiment the main body of at least one part is symmetric with respect to rotation of the main body about a longitudinal axis of rotation.

A body that is symmetric with respect to rotation about an axis may generally be one in which a cross section through the body at right angles to the axis of rotation has a circular perimeter.

For example, the main body of at least one part may be in the form of a cylinder (with or without an internal bore). The axis of rotation of such a part is the imaginary line extending longitudinally through the central points of the cross section of the cylinder.

Preferably the surface of such a part is located at one end of the cylinder.

In an embodiment where one part is in the form of a cylinder with an internal bore, the other part may include a shaft configured to be received by the bore, wherein the surface extends outwardly from the longitudinal axis such that when the shaft is positioned in the bore the frustum or truncated sphere surfaces of the two parts bear against one another.

It should be appreciated that the surface need not be on the main body. In a preferred embodiment, at least one part includes a removable part including the surface.

For example, the first part may include a shaft, and a flange extending from the shaft. The frustum or truncated sphere surface may be positioned on a removable part having an aperture or recess configured to receive the shaft such that the removable part abuts against the flange. Preferably the first part and removable parts are threaded in order to fasten the parts to each other.

The removable part may provide a different number of locators, or the locators may provide different settings. For example, in a golfing application one removable part may provide a number of loft only settings, and another removable part may provide face only settings.

It is envisaged that this may further assist in manufacture of the connector. For example, the more detailed removable part may be made of an easily plastic, with the first part of a material having greater load bearing properties such as a metal.

According to another aspect of the present invention there is provided an adjustable connector including:

- a first part and a second part, each including a main body having a longitudinal axis,
- wherein the main body of the first part includes at least two first locators, and
- wherein the main body of the second part includes at least two sets of at least two second locators,
- the connector configured such that engagement of the first locators with different sets of second locators results in different orientations of the main body longitudinal axes with respect to one another, wherein the angles of the second locators in each set relative to the longitudinal axis of the second part define the resultant orientation of the main body longitudinal axes.

According to another aspect of the present invention there is provided a method of adjusting an adjustable connector as described above, including the steps of:

arranging the first part and second part such that the at least two first locators engage one of the sets of second locators; and moving the first part relative to the second part such that the at least two first locators disengage with the set of second locators and engage with another set of second locators.

In this aspect of the present invention, it is envisaged that the locators may act as bearing surfaces between the two parts. However, such an arrangement may also be integrated into the embodiments of the present invention described above.

In a preferred embodiment the first locators are protrusions extending substantially perpendicular relative to the longitudinal axis of the first part, and the second locators are recesses in the second part configured to receive the protrusions, wherein each recess within a set is angled relative to the longitudinal axis of the second part such that engagement of the protrusions with different sets results in different orientations of the longitudinal axes with respect to one another.

In an alternative embodiment the first locators are protrusions extending along at least a portion of an exterior of the main body of the first part, substantially parallel with the longitudinal axis, and the second locators are recesses within a bore in the main body of the second part, wherein each recess within a set is angled relative to the longitudinal axis of the second part such that engagement of the protrusions with different sets results in different orientations of the longitudinal axes with respect to one another.

It should be appreciated that the reverse configuration of these embodiments is envisaged, with the sets provided by protrusions.

Once the required alignment has been established the parts may be held in relationship to one another by various means, such as (without limitation) by gluing, clamping or the use of complementary ridges and grooves on the relevant surfaces of the parts.

In a preferred embodiment at least a first part is configured to engage with an object to be connected. Preferably this first part is configured to engage with a second part/object to be connected, and the second part/object is configured to engage with a third part object.

For example in the case of a configurable golf club the first part could be a sleeve attached to a golf shaft, the second part an insert which fits to a third part, a golf club head.

Alternatively the second part (insert) could be integral with the third part (golf club head), so formed in the manufacture of the golf club head.

Reference to a part being configured to engage with, or connected to, an object to be connected should be understood to include a part that is itself an integral section of that object. This would include, for example, those embodiments where one of the parts is a section of an object to be attached, as discussed above.

In an embodiment at least one part is configured as an auto locked mechanism. Reference to an auto-locked mechanism throughout this specification should be understood to refer to a mechanism which by design, and by default, secures the elements (which may be telescoping) relative to each other. Typically an auto locked mechanism includes a body made from an elastic or deformable material.

The parts/assembly may be designed such that a tool is required to change the shape of the body so as to accept an object to be connected, and such that the body locks onto the object when the tool is removed.

Throughout this specification the term deformable material should be taken as meaning a material which is able to deform from its original shape, and has a resilience or bias to return to its original shape, i.e. the deformable material has a material memory.

In the case of a deformable self locked mechanism there may generally be an aperture for a tool and a tool designed to deform the body. This tool may be, for example, a:

1. lever
2. wedge
3. cam (elliptical or otherwise)
4. threaded element (tapered or otherwise)
5. conical element (solid, threaded, expandable or otherwise)
6. a drivable connection (eg a pin or taper)
7. an external tool such as modified pliers
8. application of heat to thermally expand an aperture or weaken a mechanical connection Any included or detail slot may be helical, straight or otherwise, and extend partially or fully along the main body of the part.

The use of an adjustable device may be illustrated by application to a golf club. However, those skilled in the art will appreciate that there are many other examples that could be used and that reference to a golf club only should not be seen as limiting.

In a preferred embodiment at least one part is configured to engage with an object to be connected.

Preferably the first part is configured to engage with a first object to be connected and the second part is configured to engage with a second object to be connected.

Reference to a part being configured to engage with, or connected to, an object to be connected should be understood to include a part that is itself an integral section of that object. This would include, for example, those embodiments where one of the parts is a section of an object to be attached, as discussed above.

The use of an adjustable connector may be illustrated by application to a golf club. However, those skilled in the art will appreciate that there are many other examples that could be used and that reference to a golf club only should not be seen as limiting.

In a preferred embodiment the object to be connected is the shaft of a golf club.

In a preferred embodiment the object to be connected is the club head of a golf club.

In a preferred embodiment the parts are secured in position by a securing mechanism.

The securing mechanism may be, for example, a threaded screw which when tightened draws the parts together.

Alternatively, the securing mechanism may be a threaded collet, cap, or screw which when tightened pushes the parts together to cause a secure friction and/or wedge connection.

It is envisaged that in the embodiment of the present invention having convex and concave surfaces, a larger radius of curvature may assist in maintaining alignment of the parts as the screw is tightened. The inventor has identified that shallower surfaces are less likely to slip relative to one another as loading is applied by the screw.

In a preferred embodiment at least one part is releasably connected to an object to be connected.

The advantage of a releasable connection is that the object may be released if subsequent re-adjustment is required. This may save time and effort in making the adjustment, as well as reducing the likelihood of damage to the object or adjustable connector, in each case saving cost.

It is envisaged that the securing mechanism may be configured to provide a sufficient lock to the parts so that a golf ball may be hit, but subsequently the parts may be repositioned to a new setting without the use of a tool. This would create a "fitting club" enabling easy configuration and testing for professionals, sales people, and golfers.

For example, in the case of a screw securing mechanism which draws the parts together, the fitting club could substitute a simple screw for a screw/compression-spring combination.

In use, applying a torque force to the screw, potentially by a suitable torque limited tool, would pull on the part attached to the golf shaft, pulling it into the club head securely, and in doing so also compress a compression spring retained therein by the same screw.

It is envisaged that the spring would be sufficiently strong to prevent complete compression by the torque provided at the limit of the torque limited tool.

On applying a rotary force to the head (generally about the hosel axis), the spring could be further compressed and allow a locator detail to relocate to another locator recess, thereby defining a new resultant orientation between the axes of the parts.

In a preferred embodiment the releasably connected part is connected by an auto-locked mechanism.

For example the hosel of a golf club may be configured to include an auto locked mechanism.

The hosel, and/or club head (where there is no hosel for example), may have one or more slots, helical, straight or otherwise, partial or full, and be of sufficient strength either as a unitary item or via the design and/or cooperation of multiple elements (which could include a conical, wedge, split or spring element for example). A suitable tool may be used to expand the hosel so that it may accept a part of the adjustable connector, with the part becoming locked in the hosel when the tool is removed.

Likewise, the shaft of a golf club may be configured to include an auto locked mechanism. The shaft may be made of a deformable material and include a slot such that operation of a suitable tool may open the shaft so as to accept a part of the adjustable connector. The shaft may be self lock to the part on an interior or exterior surface part.

Where the hosel is a deformable body or where the shaft is a deformable body each may be designed so as to auto lock or otherwise frictionally engage with a part of the adjustable connector.

Throughout this specification the hosel may be taken to include any element in contact with itself. Likewise the shaft may include any element in contact with itself. An intermediary element (such as an adjustable connector) which connects the club head and or hosel with the shaft can be taken to be a shaft in some cases and a hosel in others.

In some embodiments the of the auto locked mechanism the shaft may have one or more slots and be expandable by insertion of a plug element which bears on the inner surface of the club shaft. The expansion element, which may be helical, solid, compressible, conical, or threaded (for example), may bear against a surface of the shaft and frictionally engage. An expansion element may also be inserted from the sole or underside of the club head.

Any inserted element may also or solely serve to alter the weight of the club. A plug may retain a lead weight for example within the shaft of the hosel, or the plug may be a heavy or light material to achieve a desired change in the weight.

In the case of a non deformable hosel aperture a simple connection may be made by an interference fit with the hosel. If the aperture of the hosel is so configured the inserted part of the adjustable connector could be dovetailed by interaction with a dovetail creation detail at the apex of the hosel.

All detail described for self locked mechanisms could be used for locking mechanisms (as in a screwed in tapered element inserted to expand the split shaft), and vice versa. All details which describe the male form may be advantageously designed in the female form and vice versa.

A self locked mechanism may use an attached integral or loose spring element. This element may be expanded, shortened or rotationally deformed to achieve a locking condition.

If a spring element is used a tapered tool could be used to insert inside or outside the spring to frictionally engage. Turning the spring or tool in one direction will tend to bind more than the other way and this can be used to advantage. Alternatively the tool may be tapered or parallel and the inner or outer bore of the spring element be itself tapered. In any case the elements may also be threaded.

Where a cam tool is used to open a self locking mechanism it may be generally axially aligned to the axes of the hosel and shaft or be generally parallel to the axes of the hosel and shaft. However a cam may also be in any other orientation that affords a cam operation to release the part of the adjustable connector secured by the deformable body.

A cam tool is a good design for use in cooperation with a self locking deformable body mechanism as the lever force which opens/releases or disengages the elements, in this case a club head hosel or a golf shaft, can be defined to be insufficient to elastically deform the mechanism. The major axis of the cam cross section will define the maximal opening achievable by use of the tool.

The hosel may be in a variety of cross sections but a preferred embodiment is one which offers resistance to rotation of the shaft within the hosel. This can be achieved when the hosel and or shaft are oval or any other non circular cross section for at least some of their length. Splines, key details, and ridges/grooves may be used for a similar purpose.

The hosel may be in a variety of cross sections but a preferred embodiment is one which offers resistance to pull out of the shaft. This may be achieved when the hosel is wider in internal bore at a point closer to the sole end, than the golf clubs grip end, and is oval or any other non circular for at least some of their length. Splines, key details and ridges/grooves may be used for a similar purpose.

Where a hosel and club shaft are connected by an adjustable connector and the lie angle and loft has been adjusted, there may be a visual misalignment of the axes of the hosel and the shaft. To disguise the variable angle of the shaft relative to the hosel, or to the club head directly, a flexible or adjustable ferrule, O-ring (of any cross section) could be used. This ferrule detail may be separate, but may be click fitting or part of any of the adjacent parts. In this way variation of the shaft to club head angle may be visually disguised so the club would look more normal to the golfer's eye. This is important as golf is widely held to be as much a game of confidence as it is of pure physical skill.

According to another aspect of the present invention there is provided a golf club head, including:

a heel;

a toe;

a sole; and an elongate ground engagement portion configured to project beyond the sole, characterised in that the ground engagement portion is orientated lengthways between the heel and the toe.

It is generally desirable to have a golf club head, especially that of a driver, seated on the ground prior to instigating a swing in order to enable alignment of the club and setting of the shot. However, where orientation of the club head relative to the shaft has been adjusted, as enabled for example using an adjustable connector substantially as described above, the club head may not still sit well on the ground.

The ground engagement portion of the present invention is envisaged as compensating for such adjustments. For example, where the loft of the club is adjusted, the club head may rock either forwards or backwards on the protrusion beyond the sole—without changing lie or face angle. Similarly, with adjustment of face angle, the club head may continue to sit of the ground engagement portion without affecting lie of loft angle.

Preferably the ground engagement portion is positioned below the head's centre of mass.

The surface of the ground engagement portion which makes contact with the ground will be referred to as the ground engagement surface.

It is envisaged that the ground engagement surface may be on a plane at a plurality of points along a substantial length of the ground engagement portion. Preferably the ground engagement surface includes a straight section, however, it is envisaged that the ground engagement surface may be ridged, rippled, or otherwise patterned such that the surface is not continuously against the plane.

Preferably the ground engagement surface is curved across its width. It is envisaged that this may assist in rocking of the club on the ground engagement portion, particularly when loft angle has been adjusted.

In one embodiment the ground engagement portion may be configured to be releasably connected to the head. It is envisaged that a number of ground engagement portions may be provided where the angle of the ground engagement surface of each portion is determined by different potential lie, loft, and/or face angle settings of the club.

In one embodiment the ground engagement portion may be configured to be repositioned on the sole of the club.

Preferably the golf club head includes a recess configured to receive the ground engagement portion.

Preferably the ground engagement portion is moveably connected to the head. In particular, it is envisaged that the ground engagement portion may be moveably connected to the head such that either the heel or the toe of the head may move upwardly or downwardly relative to an end of the ground engagement portion. In doing so, when the lie angle of the club is adjusted, the angle of the ground engagement portion may be adjusted to suit.

In a preferred embodiment the ground engagement portion may pivot about an axis. It is envisaged that the axis may be generally parallel with an imaginary line between the centre of the club and the target.

BRIEF DESCRIPTION OF THE DRAWINGS

Further aspects of the present invention will become apparent from the ensuing description which is given by way of example only and with reference to the accompanying drawings in which.

DETAILED DESCRIPTION

Figure 1A:
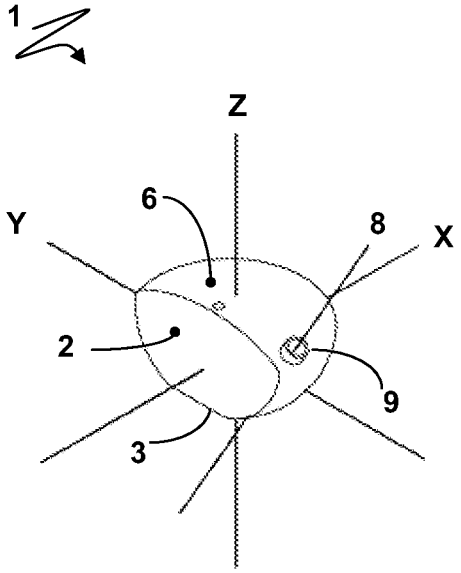
FIGS. 1*a-d* illustrate a typical driver golf club head.
Figure 1B:
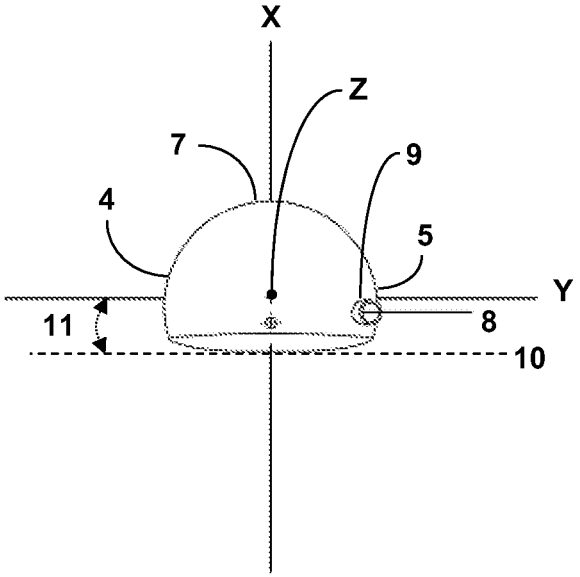

FIGS. 1*a*, 1*b*, 1*c*, and 1*d* illustrate a typical driver golf club head (1), including a face (2), sole (3), toe (4), heel (5), crown (6), rear (7), shaft axis (8) (the actual shaft is omitted for clarity), and hosel (9).

Figure 1C:
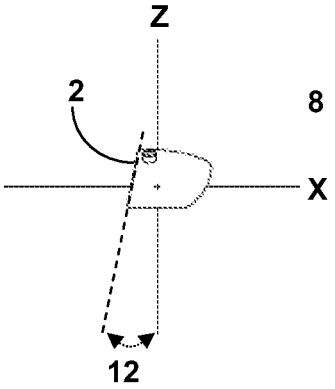
Figure 1D:
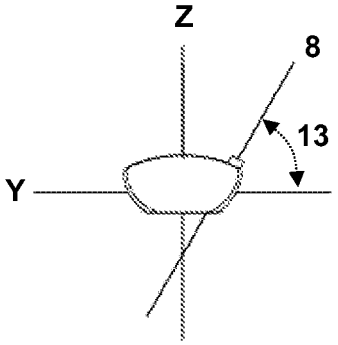

Loft, lie, and face angle parameters can be measured as angular deviations of various details from X, Y, and Z reference axes which intersect in the middle of the club head (1), namely where:

loft angle (12) is deviation of the face (2) angle from the vertical Z axis whilst rotating about the Y axis, as illustrated in FIG. 1*c*—for example 10 degrees;

lie angle (13) is deviation of the shaft axis (8) from the Z axis whilst rotating about the X axis, as illustrated by FIG. 1*d*—for example 58 degrees; and face angle (11) is deviation of a line (10) tangential to the leading edge of the face (2) from the Y axis, whilst rotating about the Z axis—for example 0 degrees.

Figure 2:
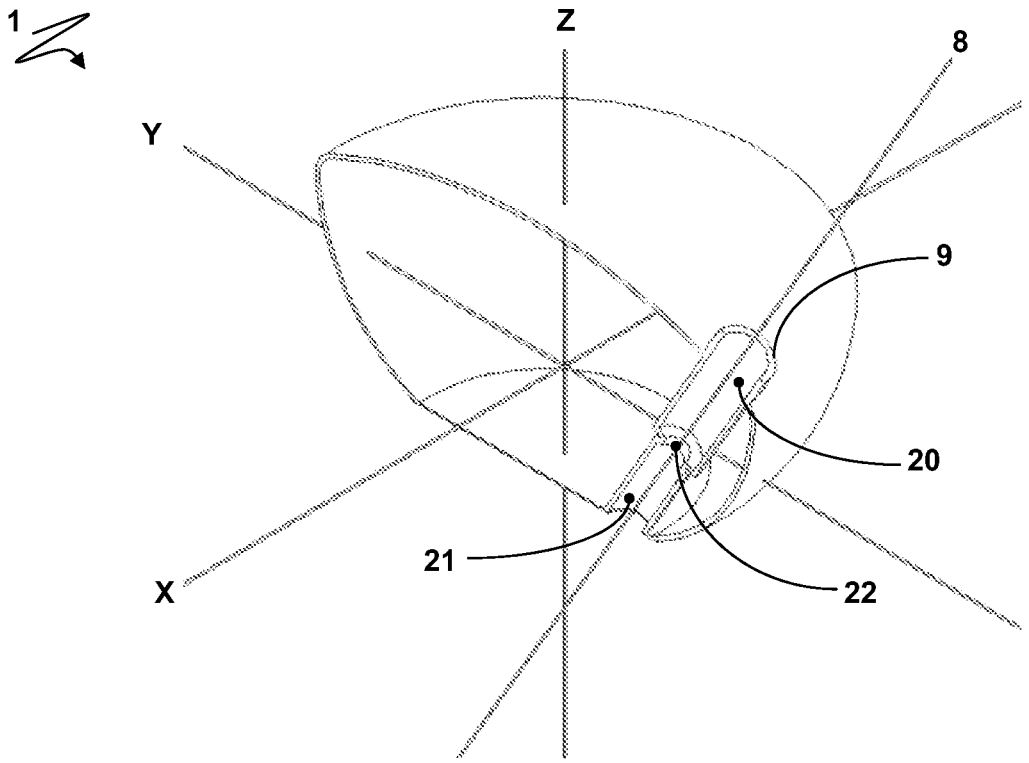
FIG. 2 provides a cutaway perspective view of a driver golf club head.

FIG. 2 illustrates a cutaway view of the club head (1) showing the hosel (9) more clearly.

The hosel (9) includes an upper hosel area (20) and lower hosel area (21) connected by an aperture (22).

A shaft connector (not illustrated) to which a golf club shaft is fixed may be inserted into the upper hosel area (20), and pulled down against the base of the upper area (20) by a threaded fastener (not illustrated) passed through the aperture (22) from the lower area (21).

Figure 3A:
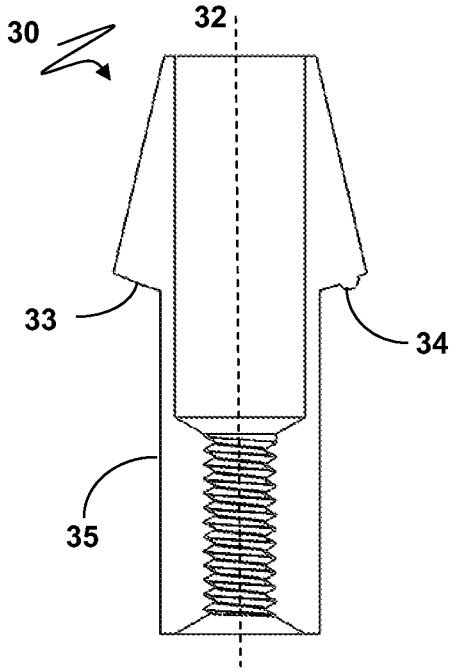
FIGS. 3*a,b* provide cross-sectional side views of an adjustable connector according to one embodiment of the present invention.
Figure 3B:
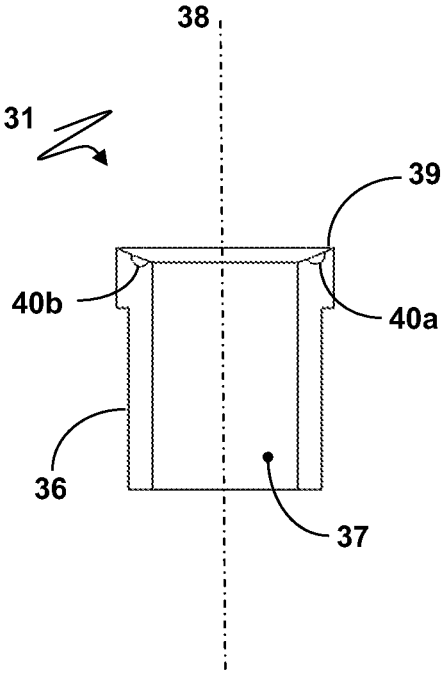

FIGS. 3*a* and 3*b* provide a cross-sectional view of an adjustable connector including a first part (30) and a second part (31).

The first part (30) includes a main body including a first longitudinal axis (32), and a spherical frustrum shaped surface (33) being generally convex. A first locator in the form of a raised dome (34) is located on the convex surface (33). A shaft (35) extends from the convex surface (33).

The second part (31) includes a main body in the form of a cylinder (36) having a bore (37) and a second longitudinal axis (38). The cylinder (36) has a second spherical frustrum shaped surface (39) being generally concave and surrounding the bore (37). A number of second locators in the form of recessed domes (40*a*, 40*b*) are located on the concave surface (39).

One recessed dome (40*a*) is located further away from the second longitudinal axis (38) than the other recessed dome (40*b*).

Figure 4:
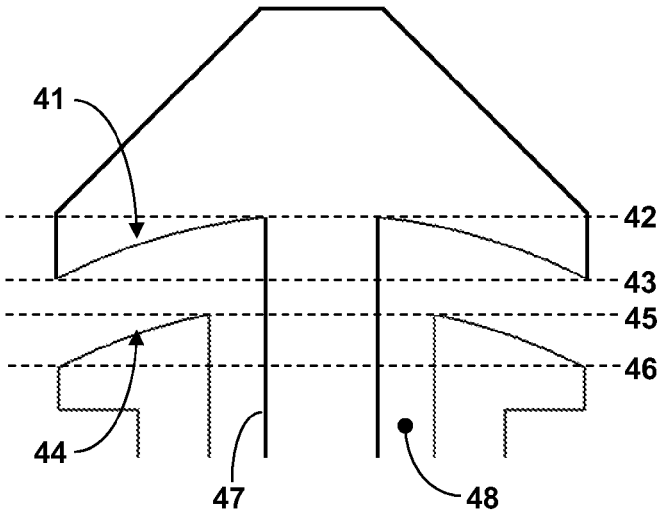
FIG. 4 illustrates frustum shaped surfaces of an adjustable connector according to an embodiment of the present invention.

The frustum shape of the surfaces is further illustrated in FIG. 4. In this embodiment a concave frustum surface (41) is defined by a sphere dissected by a first plane (42) and a second plane (43). Similarly, a convex frustum surface (44) is defined by a sphere dissected by a third plane (45) and a fourth plane (46).

Figure 5:
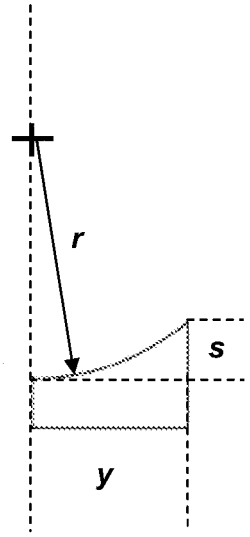
FIG. 5 illustrates calculation of sagittal depth.

These surfaces are such that the sagittal depth is less than half the radius of curvature. Referring to FIG. 5, sagittal depth may be determined using the equation:

$$s=r-\sqrt{(r^2-y^2)};$$

where s is sagittal depth, r is the radius of curvature, and y is one half of the diameter at the edge of the surface.

It should be appreciated from the attachment as illustrated in FIG. 4 that the concave and convex surfaces may be truncated spheres if the first plane (42) created by the shaft (47) and the third plane (35) created by the bore (48) were removed.

Figure 6A:
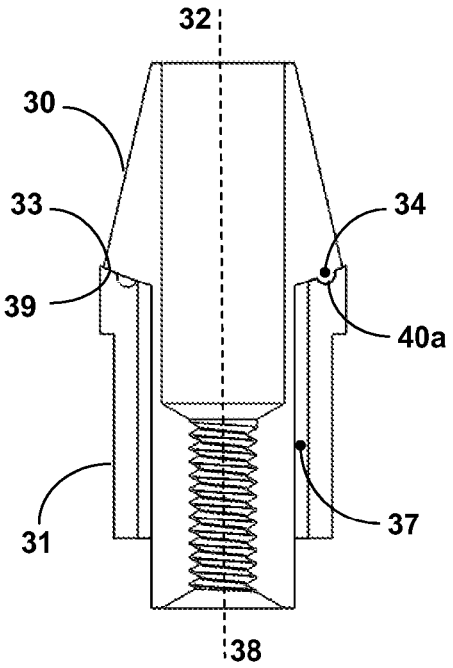
FIG. 6*a*, 6*b* provide cross-sectional side views of an adjustable connector in use according to one embodiment of the present invention.
Figure 6B:
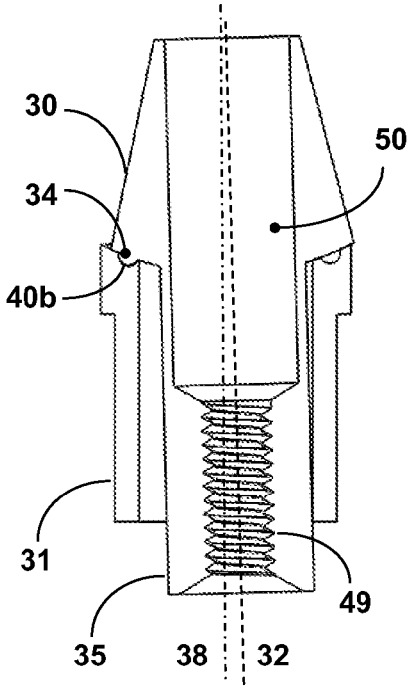
Figure 7:
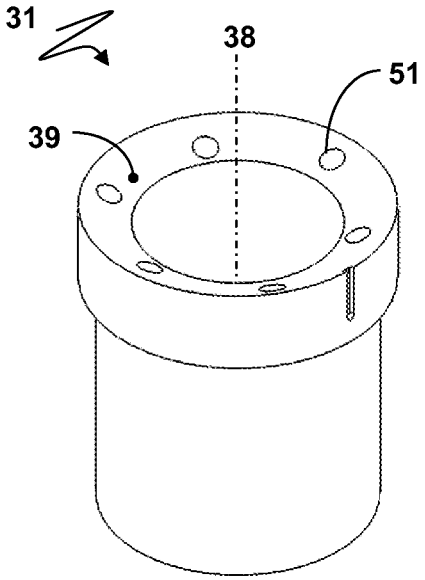
FIG. 7 provides a perspective view of a second part of an adjustable connector according to an embodiment of the present invention.

FIGS. 6*a* and 6*b* illustrate the parts of FIGS. 3*a* and 3*b* in use. The first part (30) is located relative to the second part (31) such that the shaft (35) passes into the bore (37), the convex surface (33) and concave surface (39) abut against one another, and the raised dome (34) is fitted into one of the recessed domes (40*a*).

In the embodiment illustrated by FIG. 6*a*, it may be seen that the surfaces (33, 39) are complementary and the longitudinal axes (32, 38) aligned.

In FIG. 6*b*, the first part (30) has been rotated and tilted relative to the second part (31) such that the raised dome (34) is fitted into the other recessed dome (40*b*). It may be seen that the longitudinal axes (32, 38) of the parts (30, 31) are in a different orientation to that illustrated by FIG. 6*a*.

The shaft (35) of the first part (30) includes a threaded portion (49) into which a threaded fastener (not illustrated) may be applied to draw the parts (30, 31) together—for example using the hosel (9) configuration illustrated in FIG. 2. The first part (30) also includes a cavity (50) into which a golf club shaft (not illustrated) may be fixed.

Figure 8A:
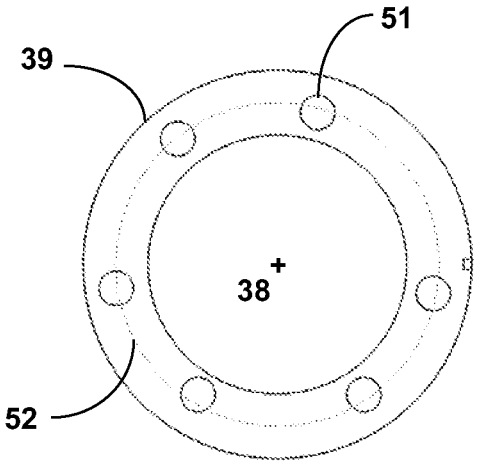
FIGS. 8*a-c* illustrate three different embodiments of locator configurations on a second part of an adjustable connector according to an embodiment of the present invention.

FIG. 8*a* illustrates the second part (31) of FIG. 3*b* from a perspective view, wherein six recessed domes (51) are positioned on the concave surface (39). It may be seen that the recessed domes (51) are at different distances relative to the longitudinal axis (38) around the bearing surface (39). The dotted line (52) marks a constant radius from the axis (38).

Figure 8B:
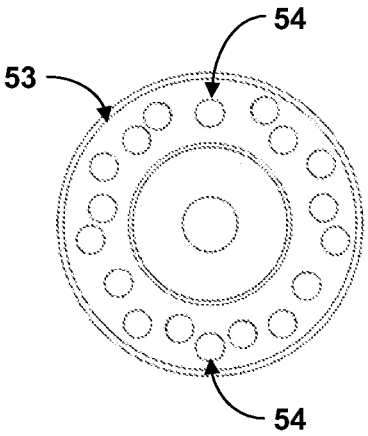

FIG. 8*b* illustrates a convex surface (53) on which paired recesses (54) are positioned. Each pair (54) is configured to engage with a pair of raised domes on a concave surface of the other part (not illustrated). The additional locator at each setting assists in providing directional stability—resisting rotation and lifting off of the surfaces.

Figure 8C:
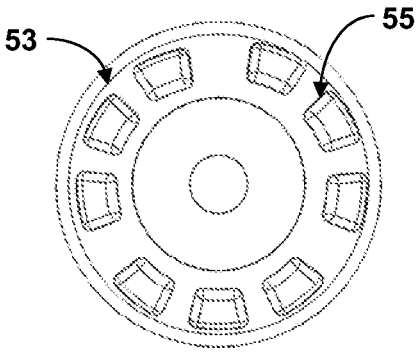

FIG. 8*c* illustrates the convex surface (53) of FIG. 8*b*, but with generally single trapezoidal recesses (55) configured to engage with a complementary raised locator on the other part. It is envisaged that the size and straight lines of the shape will assist in maintaining the parts in position relative to each other.

Figure 9A:
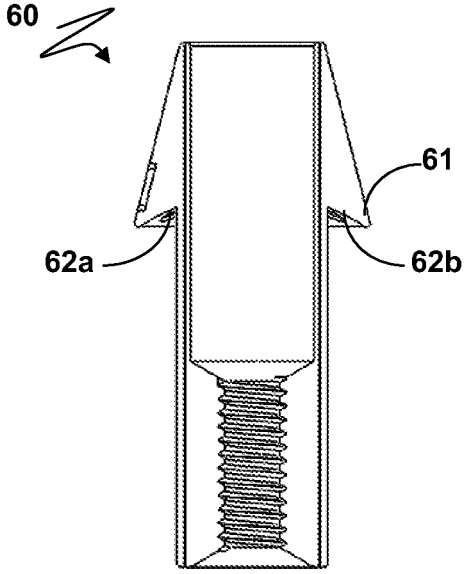
FIGS. 9*a,b* illustrate a first part of an adjustable connector according to an embodiment of the present invention.
Figure 9B:
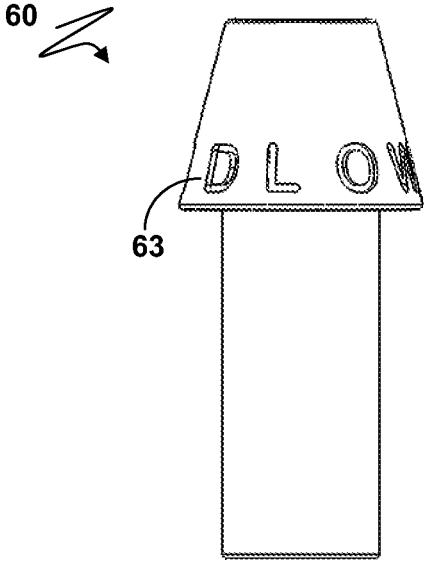

FIGS. 9*a* and 9*b* illustrate an alternative configuration of the first part (31) of FIGS. 3*a*, 6*a*, and 6*b*.

As seen in FIG. 9*a*, the first part (60) includes a concave surface (61) on which recessed domes (62*a*, 62*b*) are located. The first part (60) is configured to interact with a second part (not illustrated) generally configured in the manner of the second part (31) of FIG. 3*b*, but having a convex surface and a single raised dome.

In FIG. 9*b*, it may be seen that the exterior of the first part (60) includes symbols (63) marking different settings associated with orientation of the parts relative to one another when the raised dome is located in different recessed domes.

Figure 10A:
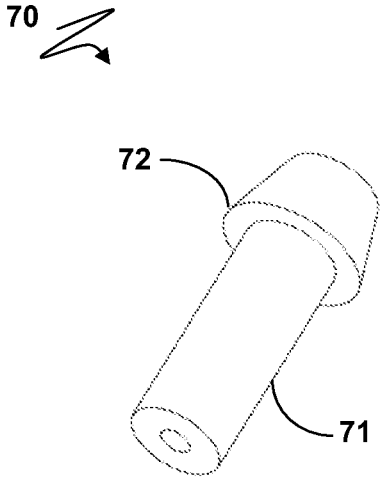
FIGS. 10*a,b* provide a perspective view of pieces of a first part of an adjustable connector according to an embodiment of the present invention.
Figure 10B:
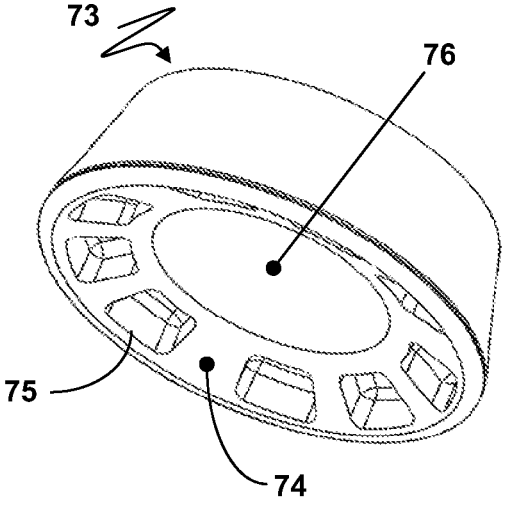

FIGS. 10*a* and 10*b* illustrate a first part having a similar configuration to that of FIGS. 9*a* and 9*b*.

In this embodiment, the part includes a main body (70) as illustrates in FIG. 10*a*. The main body (70) includes a shaft (71), and a flange (72) extending from the shaft (71).

A removable part (73) includes a spherical frustum shaped surface (74) having a number of recesses (75) located on the surface (74). The removable part (73) includes an aperture (76), enabling the removable part (73) to be slid onto the shaft (71) of the main body (70) such that the removable part (73) abuts against the flange (72). The shaft (71) and aperture (76) include complementary threads (not illustrated), enabling them to be fastened together.

Figure 11:
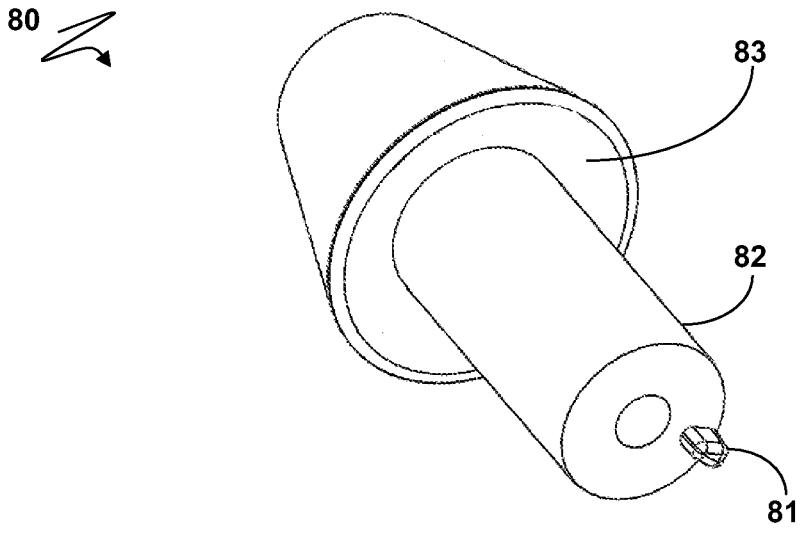
FIG. 11 provides a perspective view of a first part of an adjustable connector according to an embodiment of the present invention.

FIG. 11 illustrates an alternative embodiment of the first part (80), wherein a raised first locator (81) is positioned at the end of a shaft (82) extending from the centre of the spherical frustum shaped surface (83). The second part (not illustrated) includes a bore to receive the shaft (82), and includes recesses at a surface within the bore which engage with the first locator (81) to define orientation of the parts relative to each other.

Figure 12:
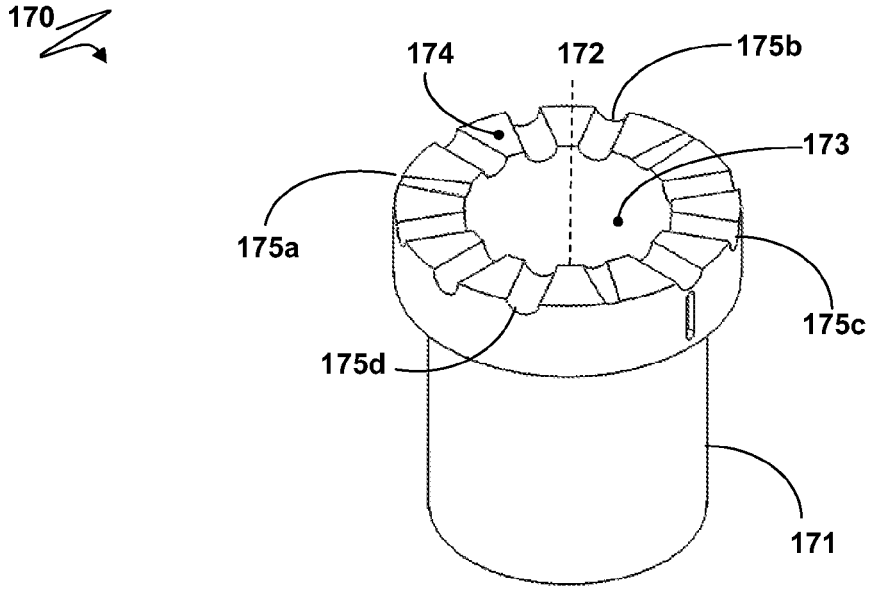
FIG. 12 provides a perspective view of a second part of an adjustable connector according to an embodiment of the present invention.
Figure 13A:
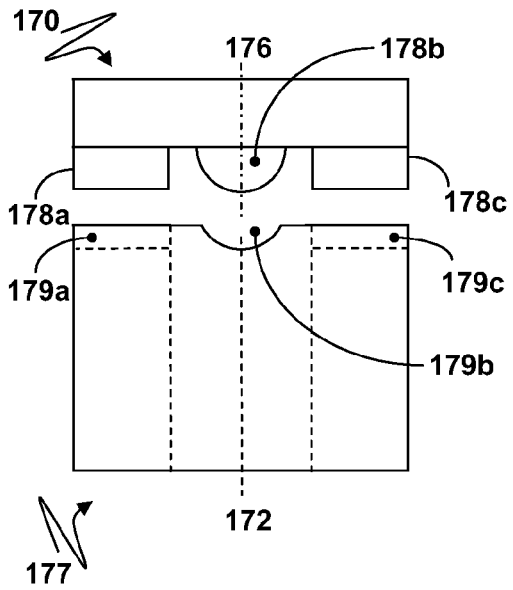
FIGS. 13*a,b* illustrate an adjustable connector in use according to another embodiment of the present invention.
Figure 13B:
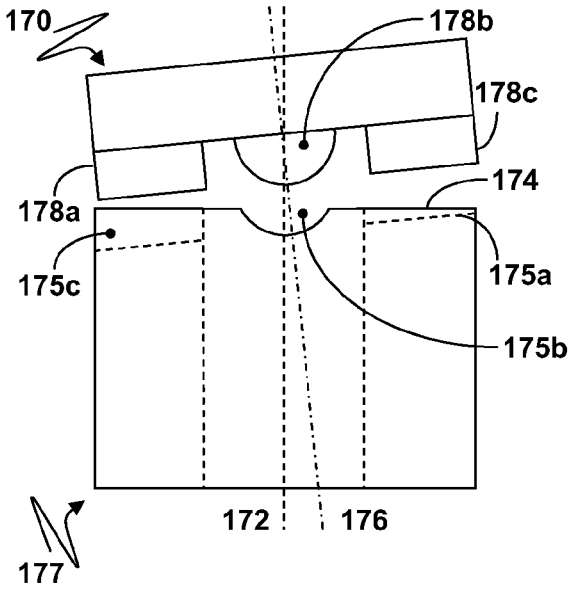

FIGS. 12, 13*a*, and 13*b* illustrate another embodiment of the adjustable connector of the present invention.

FIG. 12 illustrates a second part (170), including a main body (171) having a longitudinal axis (172) running through a bore (173). A surface (174) substantially perpendicular to the longitudinal axis (172) is located at one end of the main body (171). A number of locators in the form of hemi cylindrical recesses are located in the surface (174). The recesses are grouped in sets of four, such as recesses (175*a*, 175*b*, 175*c*, and 175*d*), with three sets of recesses in total.

A first part (not illustrated), includes four hemi cylindrical protrusions arranged to align with the recesses in terms of the angle of rotation about the longitudinal axis (172), in this example with a separation of 90 degrees.

The angle of the recesses relative to the surface (174) determines the orientation of the two parts relative to one another when the recesses are engages with the protrusions.

FIG. 13*a* illustrates such an embodiment where a longitudinal axis (176) of a first part (177) aligns with the longitudinal axis (172) of the second part (170).

The first part (177) includes four hemi cylindrical protrusions, of which three are illustrated—178*a*, 178*b*, 178*c*—each at right angles to one another and the longitudinal axis (176) of the first part (177).

The second part (170) includes a set of four hemi cylindrical recesses, of which three are illustrated—179*a*, 179*b*, 179*c*—which are also each at right angles to one another and the longitudinal axis (172) of the second part (170).

It may be seen that on alignment of the protrusions (178*a*, 178*b*, 178*c*) and recesses (179*a*, 179*b*, 179*c*) the longitudinal axes (176, 172) of the first (177) and second (170) parts respectively are also aligned.

FIG. 13*b* illustrates an embodiment where a longitudinal axis (176) of a first part (177) is in a different alignment with the longitudinal axis (172) of the second part (170) in comparison with FIG. 13*a*.

In this configuration, the parts are rotated relative to each other such that a different set of recesses—including recesses (175*a*, 175*b*, 175*c*)—are aligned with the protrusions (178*a*, 178*b*, 178*c*) of the first part.

Recesses 175*a* and 175*c* are angled relative to the surface (174) of the second part (170), such that when the protrusions (178*a*, 178*b*, 178*c*) engage the recesses (175*a*, 175*b*, 175*c*), the longitudinal axes (176, 172) of the first (177) and second (170) parts respectively are at a different angle to each other than the embodiment shown in FIG. 13*a*.

The protrusions and recesses act as bearing surfaces between the two parts as well as limiting rotation of the parts once fastened together.

Figure 14:
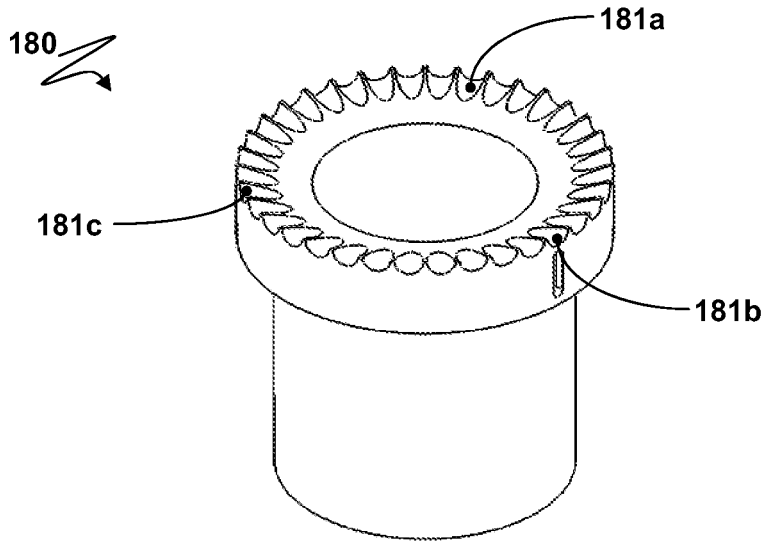
FIG. 14 provides a perspective view of a second part of an adjustable connector according to another embodiment of the present invention.

FIG. 14 illustrates an alternative configuration of a second part (180) in which the recesses are positioned in sets of three (for example 181*a*, 181*b*, 181*c*) spaced 120 degrees apart. The corresponding protrusions on the first part (not illustrated) would be spaced accordingly, and function in a similar manner to the embodiment illustrated in FIGS. 12, 13*a* and 13*b*.

Figure 15A:
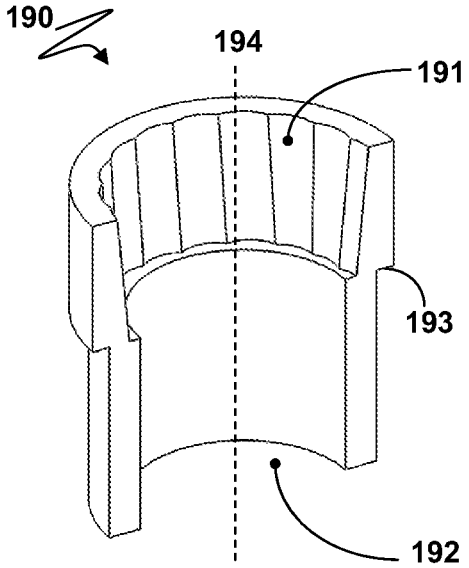
FIGS. 15*a,b* illustrate another embodiment of a second part of an adjustable connector according to another embodiment of the present invention.
Figure 15B:
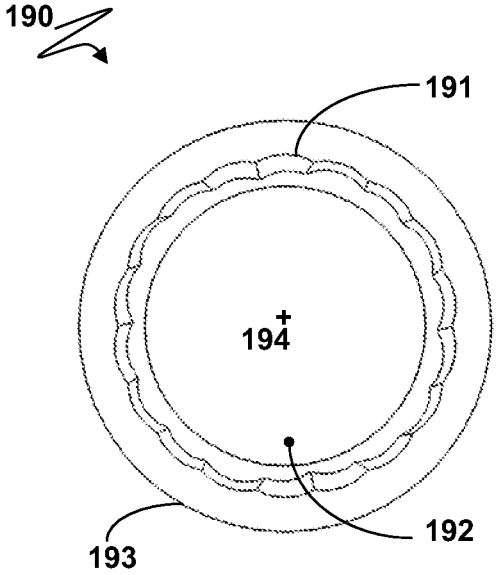

FIGS. 15*a* and 15*b* illustrate a further configuration of a second part (190) in which the second locator details are elongate recesses (191) within a bore (192) in the main body (193) of the second part (190). The corresponding first part (not illustrated) includes at least two protrusions extending along at least a portion of an exterior of the main body of the first part, substantially parallel with its longitudinal axis.

Each recess (191) within a set is angled relative to the longitudinal axis (194) of the second part (190) such that engagement of the protrusions of the first part with different sets results in different orientations of the longitudinal axes of the parts with respect to one another.

Figure 16A:
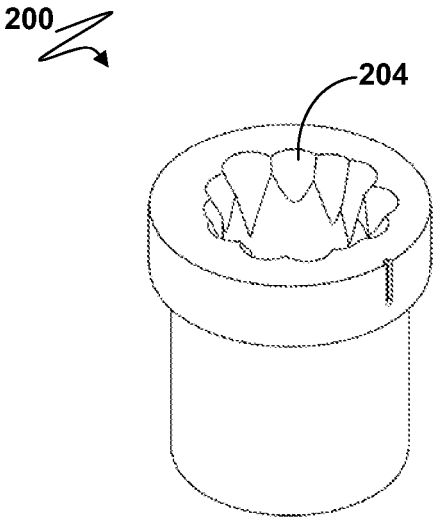
FIGS. 16*a-c* illustrate an adjustable connector according to another embodiment of the present invention.
Figure 16B:
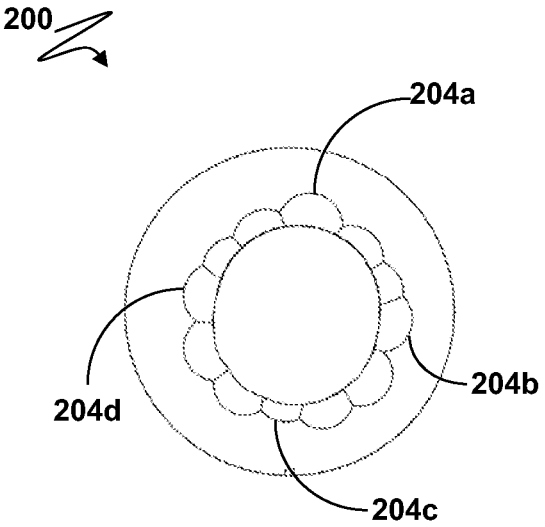
Figure 16C:
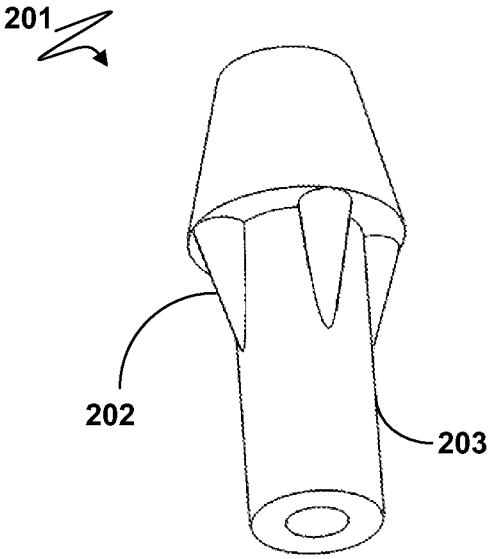

FIGS. 16*a* and 16*b* illustrate an alternative configuration of a second part (200) generally arranged in a similar manner to that of FIGS. 15*a* and 15*b*, configured to interact with a first part (201) of FIG. 16*c*.

The first part (201) includes first locators in the form of tapered protrusions (202) extending along a shaft (203). The corresponding second part (200) includes three sets of tapered recessed second locators (for example recesses 204*a*, 204*b*, 204*c*, 204*d*), each set angled according to the desired orientation of the axes of the parts relative to one another when the protrusions (202) are inserted into the recesses (204).

Figure 17:
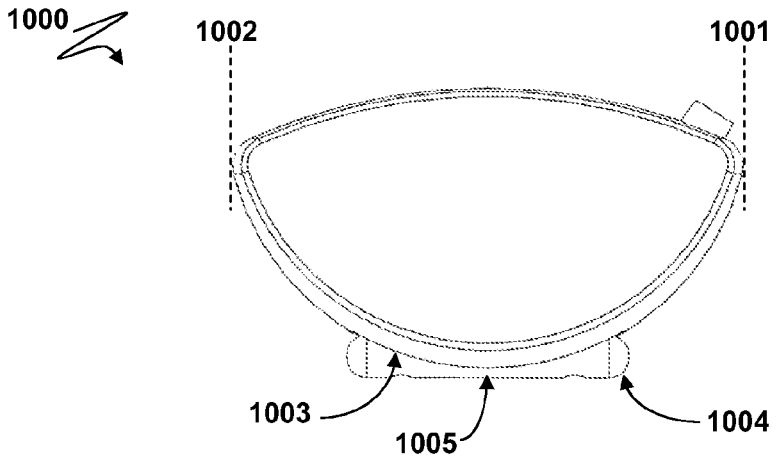
FIG. 17 provides a front view of a golf club head according to another embodiment of the present invention.

FIG. 17 illustrates a golf club head (generally indicated by arrow 1000) including a heel (1001), a toe (1002), and a sole (1003).

The head (1000) also includes an elongate ground engagement portion (1004) in the form of a cylinder with hemispherical ends. The ground engagement portion (1004) projects beyond the sole (1003), and is orientated lengthways between the heel (1001) and the toe (1002). A straight ground engagement surface (1005) rests flat against the ground.

Figure 18A:
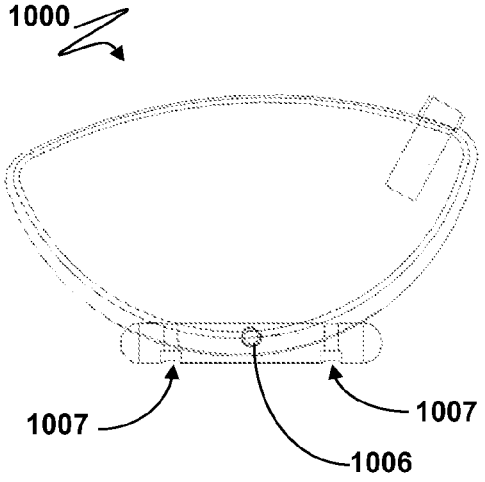
FIGS. 18*a,b* illustrate operation of a ground engagement portion in a golf club head according to another embodiment of the present invention.
Figure 18B:
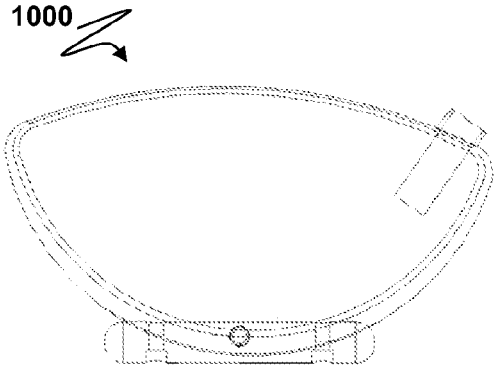

As seen in FIGS. 18*a* and 18*b*, the ground engagement portion (1004) is connected to the head (1000) by a pivot (1006). The ground engagement portion (1004) rotates around the pivot (1006) in order to allow the ground engagement surface (1005) to rest on the ground when the lie angle of the club is adjusted.

FIG. 18*a* illustrates the orientation of the ground engagement portion (1004) relative to the heel (1001) and the toe (1002) when the club is adjusted to have an upright lie angle. FIG. 18*b* illustrates the club head when adjusted to have a flat lie angle.

The ground engagement portion (1004) includes two threaded apertures (1007), one towards each end of the ground engagement portion (1004). Grub screws (not illustrated) may be inserted into the apertures (1007) and tightened or loosened as required to fix the ground engagement portion (1004) in place relative to the head (1000).

Figure 19A:
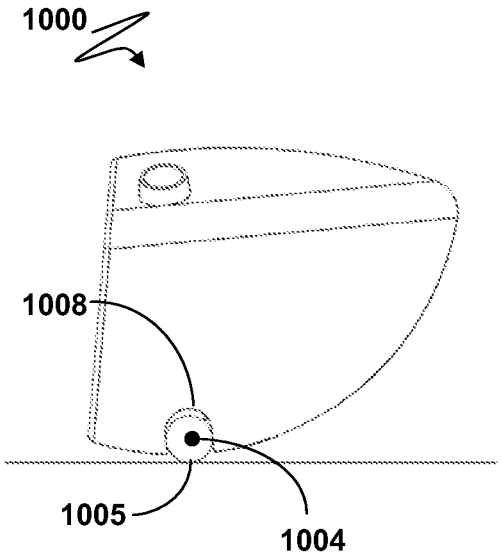
FIGS. 19*a-c* illustrate operation of a ground engagement portion in a golf club head according to another embodiment of the present invention.

As illustrated in FIG. 19*a* the head (1000) includes a recess (1008) configured to receive the ground engagement portion (1004). The ground engagement portion (1004) is positioned below the centre of mass of the head (1000).

Figure 19B:
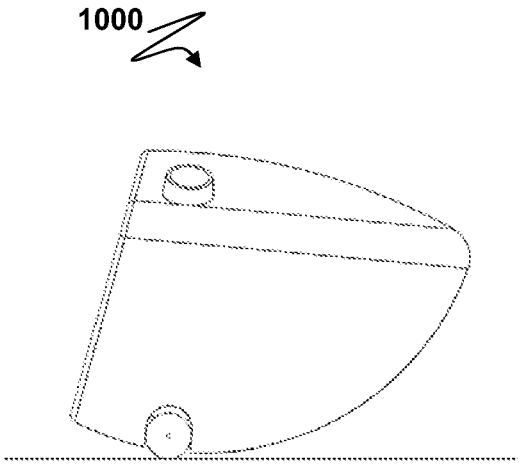
Figure 19C:
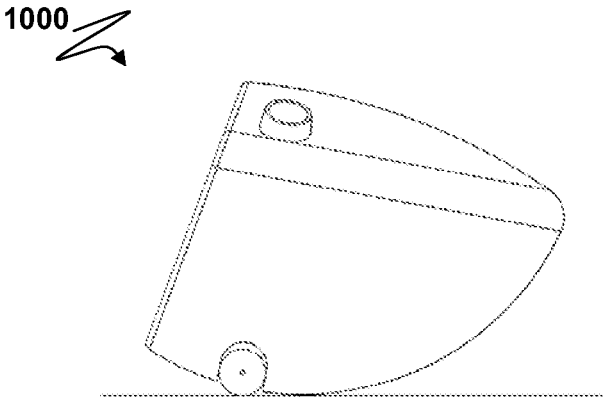

FIG. 19*a* illustrates a golf club configuration where the loft angle has been reduced. FIGS. 19*b* and 19*c* illustrate a standard loft angle and increased loft angle respectively.

It may be seen that as loft angle is increased, the club head (1000) may rock backwards on the ground engagement portion (1004) protruding beyond the sole—without changing lie or face angle.

Aspects of the present invention have been described by way of example only and it should be appreciated that modifications and additions may be made thereto without departing from the scope thereof as defined in the appended claims.

What I claim is:

1. An adjustable connector comprising:

a first part and a second part, each comprising a main body having a central longitudinal axis, wherein one part of said first part and said second part comprises at least one first locator, and the other part of said first part and said second part comprises at least two second locators, the connector configured such that engagement of the first locator with different second locators results in different orientations of the main body central longitudinal axes with respect to one another wherein at least two of the second locators are each located at different distances from the central longitudinal axis of said other part, and each part of said first part and said second part includes a frustum shaped surface, the surfaces configured to abut against each other in at least one orientation of the longitudinal axes.

2. An adjustable connector as claimed in claim 1, wherein each frustum shaped surface is a spherical frustum.

3. An adjustable connector as claimed in claim 2, wherein the radius of curvature of the surfaces is equal to or greater than 8 millimeters.

4. An adjustable connector as claimed in claim 2, wherein the radius of curvature of the surfaces is in the range of 15 to 25 millimeters.

5. An adjustable connector as claimed in claim 2, wherein the radius of curvature of the surfaces is 20 millimeters.

6. An adjustable connector as claimed in claim 1, wherein one of the first or second locators is a protrusion, and the other locator is a recess configured to receive the protrusion.

7. An adjustable connector as claimed in claim 1, wherein the locators are located on the surfaces.

8. An adjustable connector as claimed in claim 1, wherein the main body of at least one part of said first part and said second part is symmetric with respect to rotation of the main body about a longitudinal axis of rotation.

9. An adjustable connector as claimed in claim 1, wherein one part is in the form of a cylinder with an internal bore; and the other part comprises a shaft configured to be received by the bore, wherein the surface extends outwardly from the longitudinal axis such that when the shaft is positioned in the bore the surfaces of the two parts touch.

10. An adjustable connector as claimed in claim 1, wherein at least one of the parts of said first part and said second part is configured to engage with an object.

11. An adjustable connector as claimed in claim 10, wherein the object is the shaft of a golf club.

12. An adjustable connector as claimed in claim 10, wherein the object is the club head of a golf club.

13. An adjustable connector as claimed in claim 10, wherein at least one part of said first part and said second part is releasably connected to the object.

14. An adjustable connector as claimed in claim 10, wherein at least one part of said first part and said second part is configured as an auto locked mechanism.

15. An adjustable connector as claimed in claim 1, wherein the parts are secured in position by a securing mechanism.

16. An adjustable connector as claimed in claim 15, wherein the securing mechanism comprises a threaded screw which when tightened draws the parts together.

17. An adjustable connector as claimed in claim 15, wherein the securing mechanism comprises a threaded portion which when tightened pushes the parts together.

18. A method of adjusting an adjustable connector as claimed in claim 1, comprising the steps of:

abutting the surfaces to one another such that the at least one first locator engages one of the second locators; and moving the first part relative to the second part such that the first locator disengages with the second locator and engages with another second locator.

* * * * *